US009770377B2

(12) United States Patent
Isozumi et al.

(10) Patent No.: US 9,770,377 B2
(45) Date of Patent: Sep. 26, 2017

(54) MOVEMENT ASSISTANCE ROBOT

(71) Applicant: FUJI MACHINE MFG. CO., LTD., Chiryu (JP)

(72) Inventors: Joji Isozumi, Nagakute (JP); Kazuaki Mori, Anjo (JP); Nobuyuki Nakane, Toyota (JP); Hideaki Nomura, Toyota (JP)

(73) Assignee: FUJI MACHINE MFG. CO., LTD., Chiryu (JP)

( * ) Notice: Subject to any disclaimer, the term of this patent is extended or adjusted under 35 U.S.C. 154(b) by 0 days.

(21) Appl. No.: 14/766,633

(22) PCT Filed: Feb. 7, 2013

(86) PCT No.: PCT/JP2013/052889
§ 371 (c)(1),
(2) Date: Aug. 7, 2015

(87) PCT Pub. No.: WO2014/122751
PCT Pub. Date: Aug. 14, 2014

(65) Prior Publication Data

US 2015/0359691 A1 Dec. 17, 2015

(51) Int. Cl.
*A61G 5/14* (2006.01)
*A61G 5/04* (2013.01)
(Continued)

(52) U.S. Cl.
CPC ..... *A61G 5/14* (2013.01); *A61G 5/04* (2013.01); *A61G 7/1019* (2013.01); *A61H 3/04* (2013.01);
(Continued)

(58) Field of Classification Search
CPC ..... A61G 5/14; A61G 5/04; A61G 7/1019; A61H 3/04; A61H 2003/006; A61H 2003/002; A61H 2003/043
See application file for complete search history.

(56) References Cited

U.S. PATENT DOCUMENTS 5,701,965 A * 12/1997 Kamen ..... A61G 5/04 180/21
5,971,091 A * 10/1999 Kamen ..... A61G 5/04 180/218
(Continued)

FOREIGN PATENT DOCUMENTS

JP 8-215250 A 8/1996
JP 9 66082 3/1997
(Continued)

OTHER PUBLICATIONS

Translations of Foreign Prior Art JP 2011-19571 and JP 2000-210339.*
(Continued)

*Primary Examiner* — Kevin Hurley
*Assistant Examiner* — Gabriela C Craciun
(74) *Attorney, Agent, or Firm* — Oblon, McClelland, Maier & Neustadt, L.L.P.

(57) ABSTRACT

There is provided a movement assistance robot in which a single type of movement assistance robot can take care of multiple users having different physical abilities. A movement assistance robot 20 includes a robot arm unit 22 that is disposed in a base 21 traveling using drive wheels driven by a drive source, that includes multiple arms which are mutually and relatively movable by a drive unit, and that is configured to be transformable into multiple form types respectively coping with multiple movement postures (standing-upright walking assistance mode, hand support walking assistance mode, elbow support walking assistance
(Continued)

mode, standing-upright riding movement mode, and seat riding movement mode) of a care receiver M1, a holding unit 23 that is disposed in a distal end portion of the robot arm unit 22 so as to support a care receiver, a selective operation unit that selects one form type from the multiple form types, and a transformation control unit that drives the drive unit and transforms the robot arm unit into a form type selected by the selective operation unit.

6 Claims, 11 Drawing Sheets

(51) Int. Cl.
*A61G 7/10* (2006.01)
*A61H 3/04* (2006.01)
*A61H 3/00* (2006.01)

(52) U.S. Cl.
CPC ..... *A61G 2200/52* (2013.01); *A61G 2200/54* (2013.01); *A61G 2200/60* (2013.01); *A61H 2003/002* (2013.01); *A61H 2003/006* (2013.01); *A61H 2003/043* (2013.01)

(56) References Cited

U.S. PATENT DOCUMENTS 7,544,172 B2 * 6/2009 Santos-Munne ..... A61H 3/008 601/5
8,375,484 B2 2/2013 Ota et al.
9,393,698 B1 * 7/2016 Vo ..... B25J 11/009
2008/0079230 A1 4/2008 Graham
2011/0201978 A1 * 8/2011 Jeon ..... A61G 5/045 601/35
2011/0238217 A1 * 9/2011 Kume ..... A61G 7/1017 700/275
2012/0283929 A1 * 11/2012 Wakita ..... A61G 5/04 701/99
2013/0046438 A1 * 2/2013 Summer ..... A61G 5/10 701/36
2015/0005938 A1 1/2015 Suzuki et al.

FOREIGN PATENT DOCUMENTS

JP 2000 210339 8/2000
JP 2011 19571 2/2011
JP 2012 30077 2/2012
WO WO 2005/122692 A2 12/2005
WO WO 2006/023539 A2 3/2006

OTHER PUBLICATIONS

International Search Report Issued May 7, 2013 in PCT/JP2013/052889 filed Feb. 7, 2013.
U.S. Appl. No. 14/764,443, filed Jul. 29, 2015, Isozumi, et al.
U.S. Appl. No. 14/766,661, filed Aug. 7, 2015, Suzuki, et al.
Extended European Search Report issued Sep. 9, 2016 in Patent Application No. 13874547.6.
Japanese Office Action issued Sep. 6, 2016 in Patent Application No. 2014-560570 (English Translation only).

* cited by examiner

FIG. 9

| FORM TYPE | FIRST ANGLE (θa) | SLIDE AMOUNT (L) | SECOND ANGLE (θb) |
|---|---|---|---|
| STANDING-UPRIGHT WALKING ASSISTANCE FORM TYPE | θa1 | L1 | θb1 |
| ELBOW SUPPORT WALKING ASSISTANCE FORM TYPE | θa2 | L2 | θb2 |
| HAND SUPPORT WALKING ASSISTANCE FORM TYPE | θa3 | L3 | θb3 |
| STANDING-UPRIGHT RIDING MOVEMENT FORM TYPE | θa4 | L4 | θb4 |
| SEAT RIDING MOVEMENT FORM TYPE | θa5 | L5 | θb5 |

MOVEMENT ASSISTANCE ROBOT

TECHNICAL FIELD

The present disclosure relates to a movement assistance robot which assists a movement of a care receiver.

BACKGROUND ART

As a type of movement assistance robot, a movement assistance robot disclosed in PTL 1 is known. As illustrated in FIG. 3 of PTL 1, in the movement assistance robot, if a sitting user drives an electric motor 17 in a predetermined direction by gripping and operating one operation handle 21*a* while respective extension portions 19*a* of a support member 19 in which a movable member 11 is moved to a downward limit position with respect to a support portion 7 are held under the user's arms, the movable member 11 is moved upward with respect to the support unit 7 by a feed screw 15 rotating in a desired direction. In this manner, the user is lifted and allowed to stand upright by the support member 19 moving upward.

Then, if the user is allowed to stand upright to a position where the user can grip the respective extension portions 19*a*, the user stops gripping and operating the operation handle 21*a*, and stops the upward movement of the movement member 11. In this state, the user can walk while gripping the respective extension portions 19*a* and moving a traveling member 3 in a desired direction.

In addition, as another type of movement assistance robot, a movement assistance robot disclosed in PTL 2 is known. As disclosed in PTL 2, the movement assistance robot can assist a user to switch between a non-upright position and an upright position. In addition, the movement assistance robot can promote the user's walking by providing a cooperating mode and an autonomous mode which guide the user to the user's destination.

CITATION LIST

Patent Literature

PTL 1: JP-A-9-066082
PTL 2: JP-A-2012-030077

BRIEF SUMMARY

Technical Problem

According to the movement assistance robot disclosed in PTL 1 described above, the user can walk while gripping the respective extension portions 19*a* and moving the traveling member 3 in the desired direction. In addition, according to the movement assistance robot disclosed in PTL 2 described above, the user's walking can be promoted by providing the cooperating mode and the autonomous mode which guide the user to the user's destination. However, in any case, the movement assistance robot can be limitedly used depending on a user's physical abilities. Consequently, it is necessary to prepare various types of movement assistance robot which can satisfy different physical abilities.

The present disclosure is made in order to solve the above-described problem, and an object thereof is to provide a movement assistance robot in which a single type of movement assistance robot can take care of multiple users having different physical abilities.

Solution to Problem

In order to solve the above-described problem, according to the present disclosure, there is provided a movement assistance robot which assists a movement of a care receiver. The movement assistance robot includes a base that travels using drive wheels driven by a drive source, a robot arm unit that includes multiple arms which are disposed in the base and are relatively movable to and from each other by a drive unit, and that is configured to be transformable into multiple form types in accordance with respective multiple movement postures of the care receiver, a holding unit that is disposed in a distal end portion of the robot arm unit, and that supports the care receiver, a selective operation unit that selects a form type from the multiple form types, and a transformation control unit that drives a drive unit, and that transforms the robot arm unit into the form type which is selected by the selective operation unit.

BRIEF DESCRIPTION OF DRAWINGS

FIG. 9 is a table illustrating respective reference coordinate data items for coping with each form type.

DETAILED DESCRIPTION

Figure 1:
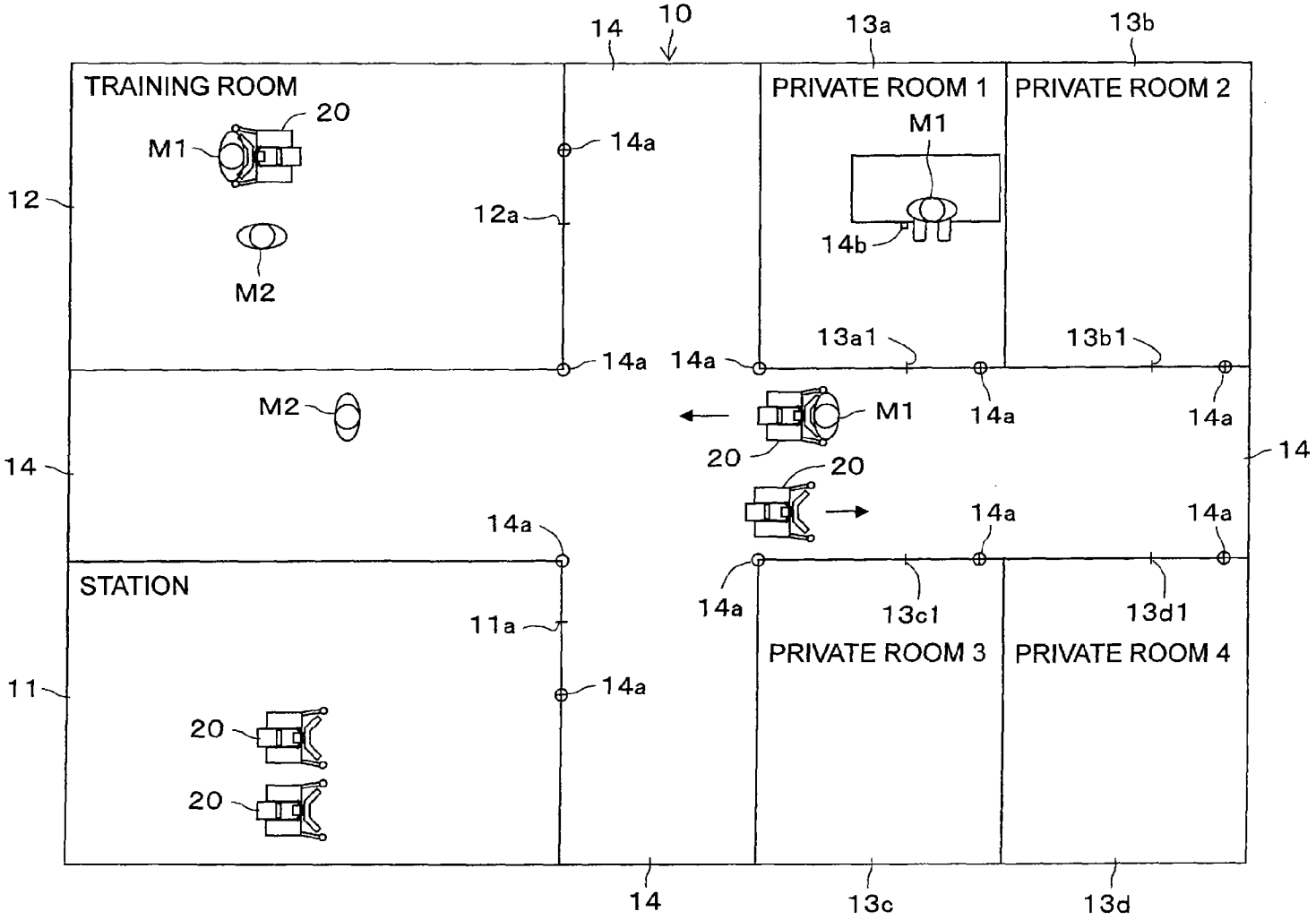
FIG. 1 is a schematic diagram illustrating a scheme of a care center in which a movement assistance robot is arranged according to an embodiment of the present disclosure.

Hereinafter, an embodiment of a movement assistance robot according to the present disclosure will be described. FIG. 1 is a schematic view illustrating a scheme of a care center 10 where movement assistance robots 20 are arranged. The care center 10 has a station 11, a training room 12, and respective private rooms 13*a* to 13*d*. The care center 10 is a residential area where persons live. The persons living in the care center 10 are care receivers M1 who require care and caregivers M2 who take care of the care receivers M1.

As illustrated in FIG. 1, the station 11 is an office of the caregivers M2, and serves as a base where the movement assistance robots 20 are on standby or charged. The movement assistance robot 20 is allowed to move in the residential area where the persons live, and is moved in the residential area by driving left and right drive wheel motors 21*g* and 21*h* serving as drive sources. The training room 12 is a room where the care receivers M1 are in training or rehabilitation. The respective private rooms are rooms 13*a* to 13*d* where the care receivers M1 live.

The station 11, the training room 12, and the respective private rooms 13*a* to 13*d* have respective entrances/exits 11*a*, 12*a*, and 13*a*1 to 13*d*1. The respective entrances/exits 11*a*, 12*a*, and 13*a*1 to 13*d*1 are connected to one another via a corridor 14. In FIG. 1, arrows in the vicinity of the movement assistance robots 20 indicate traveling directions of the movement assistance robots 20.

Figure 2:
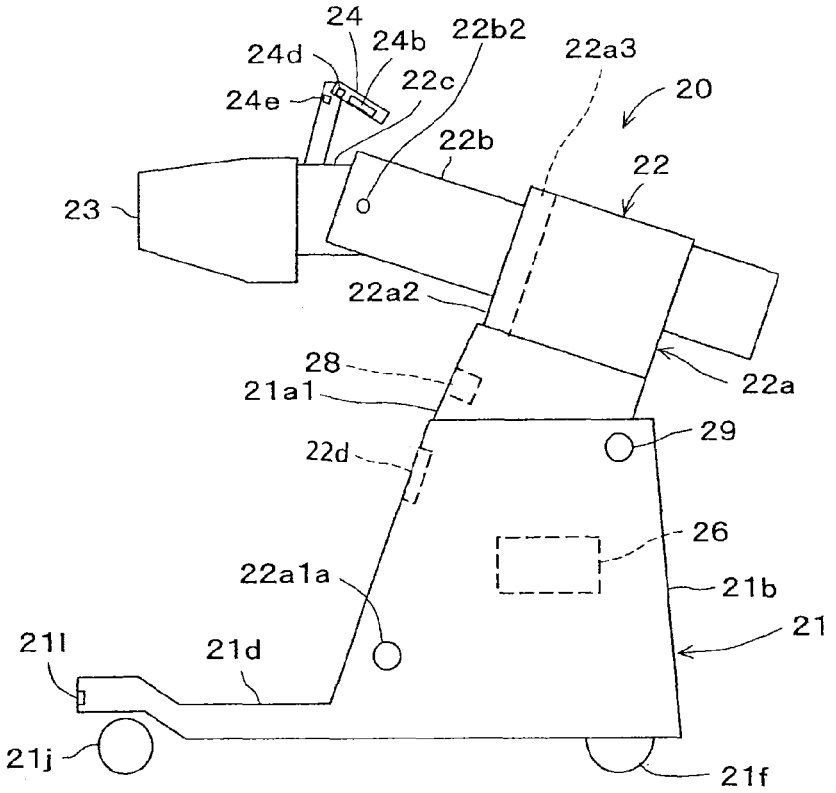
FIG. 2 is a right side view illustrating the movement assistance robot illustrated in FIG. 1.
Figure 3:
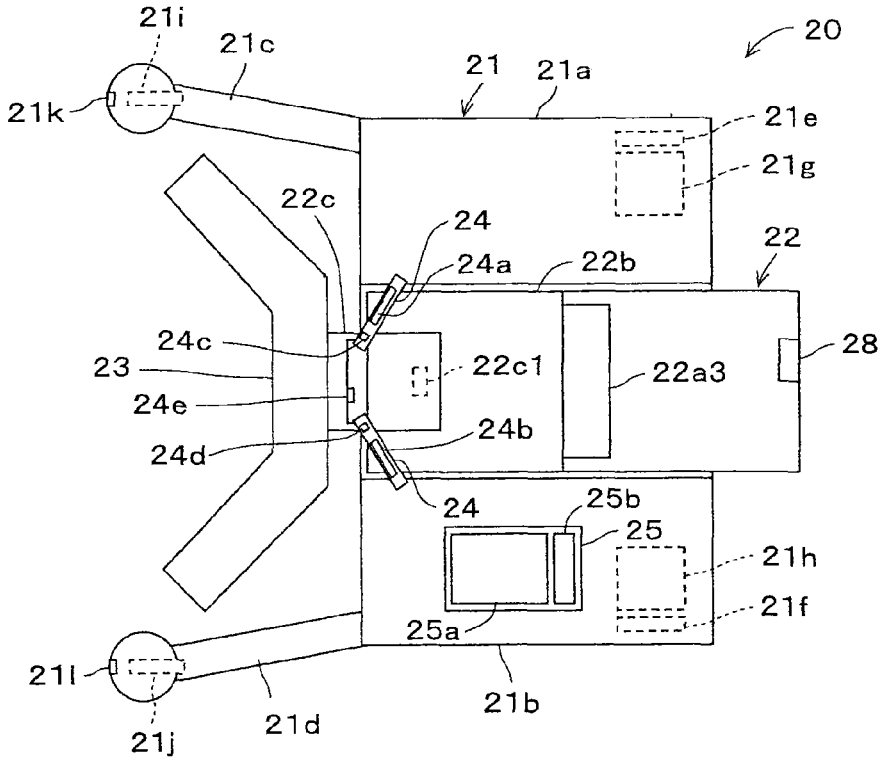
FIG. 3 is a plan view illustrating the movement assistance robot illustrated in FIG. 1.

The movement assistance robot 20 is a movement assistance robot for assisting the movement of the care receiver M1. As illustrated in FIGS. 2 and 3, the movement assistance robot 20 is configured to include a base 21, a robot arm unit 22, a holding unit 23, a handle 24, an operation device 25, and a control device 26.

The base 21 includes left and right base portions 21*a* and 21*b* and left and right leg portions 21*c* and 21*d*. The left and right base portions 21*a* and 21*b* are arranged at a predetermined distance therebetween in a lateral direction. Left and right drive wheels 21*e* and 21*f* are respectively disposed in the left and right base portions 21*a* and 21*b*, in which left and right drive wheel motors 21*g* and 21*h* (drive sources) for respectively driving the left and right drive wheels 21*e* and 21*f* are incorporated. The movement assistance robot 20 travels using the left and right drive wheels 21*e* and 21*f* which are respectively driven by the left and right drive wheel motors 21*g* and 21*h* (drive sources).

The movement assistance robot 20 includes an inclination detection sensor 31 which detects an inclination angle θ with respect to a horizontal plane. The inclination detection sensor 31 is disposed in the base 21. For example, the inclination detection sensor 31 is configured to have a gyro sensor which can detect angular velocity.

The left and right leg portions 21*c* and 21*d* are disposed to extend horizontally in a forward direction (leftward direction in FIGS. 2 and 3) from the left and right base portions 21*a* and 21*b*. Left and right driven wheels 21*i* and 21*j* are respectively disposed in distal end portions of the left and right leg portions 21*c* and 21*d*. In addition, a pair of collision prevention sensors 21*k* and 21*l* are respectively disposed in distal ends of the left and right leg portions 21*c* and 21*d*. The collision prevention sensors 21*k* and 21*l* are sensors for detecting an obstacle, and a detection signal thereof is transmitted to the control device 26.

Figure 8:
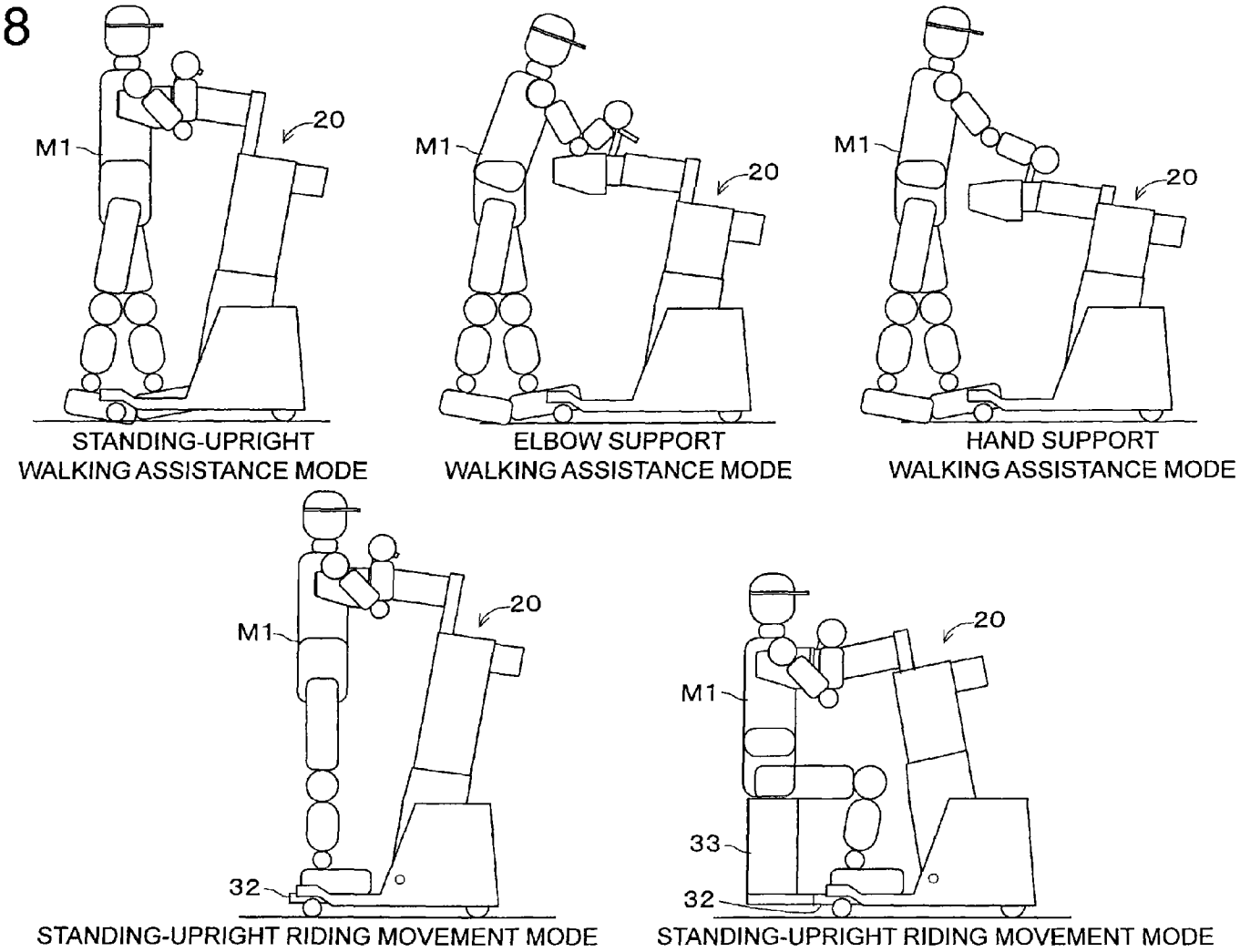
FIG. 8 is a view illustrating movement postures of a care receiver which respectively cope with each reference coordinate data item stored in a storage device illustrated in FIG. 6.

As illustrated in FIG. 8, a footrest 32 used in a standing-upright riding movement form type (to be described later) may be disposed in the base 21. The footrest 32 is a plate-shaped member on which the care receiver M1 standing upright puts his or her feet. The footrest 32 may be configured to be disposed across and fixed to the left and right leg portions 21*c* and 21*d*, or may be configured to be automatically drawn out from the left and right leg portions 21*c* and 21*d*. In addition to the footrest 32, a chair 33 used in a seat riding movement form type (to be described later) may be disposed therein. The chair 33 may be an integrated type with the footrest 32, or may be a separate type which can be attached thereto later.

The robot arm unit 22 is configured so that a base portion thereof is attached to the base 21. As mainly illustrated in FIGS. 4*a* and 5*a*, the robot arm unit 22 includes multiple arms 22*a*, 22*b*, and 22*c* which are mutually and relatively movable by using a drive unit configured to include first and second rotation-purpose motors 22*a*1*c* and 22*b*3 and a slide-purpose motor 22*a*2*b*. The robot arm unit 22 may be configured to include multiple shafts. In this case, the shaft may include at least any one of a rotary shaft and a slide shaft.

As illustrated in FIGS. 4*a*, 4*b*, and 5*a* to 5*c*, a base portion of the first arm 22*a* is attached to the base 21. The first arm 22*a* includes a slide base portion 22*a*1, a first slide portion 22*a*2, and a second slide portion 22*a*3.

As illustrated in FIGS. 2 and 3, the slide base portion 22*a*1 is formed in a substantially rectangular parallelepiped shape. The slide base portion 22*a*1 includes a frame 22*a*1*b* whose base end portion is attached to the base 21 so as to be rotatable around a first rotary shaft 22*a*1*a*. The frame 22*a*1*b* is formed in a substantially U-shape in cross section, and is configured to include left and right plate-shaped members 22*a*1*b*1 and 22*a*1*b*2 which are formed to be bent, and a rear plate-shaped member 22*a*1*b*3 whose left and right ends are connected to upper portion rear ends of the left and right plate-shaped members 22*a*1*b*1 and 22*a*1*b*2.

The first rotation-purpose motor 22*a*1*c* is disposed in the base 21. A first drive belt 22*a*1*d* is disposed across a pulley of the first rotation-purpose motor 22*a*1*c* and a pulley of the first rotary shaft 22*a*1*a*. If the first rotation-purpose motor 22*a*1*c* is driven, the frame 22*a*1*b*, that is, the slide base portion 22*a*1 is rotated around the first rotary shaft 22*a*1*a* in a forward or rearward direction.

Figure 4B:
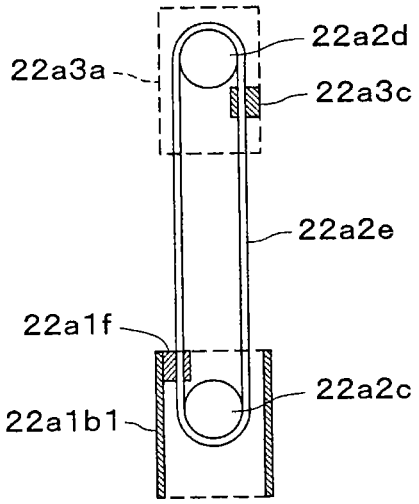
FIG. 4*b* is a front view illustrating the vicinity including a first slide portion illustrated in FIG. 4*a*.
Figure 5A:
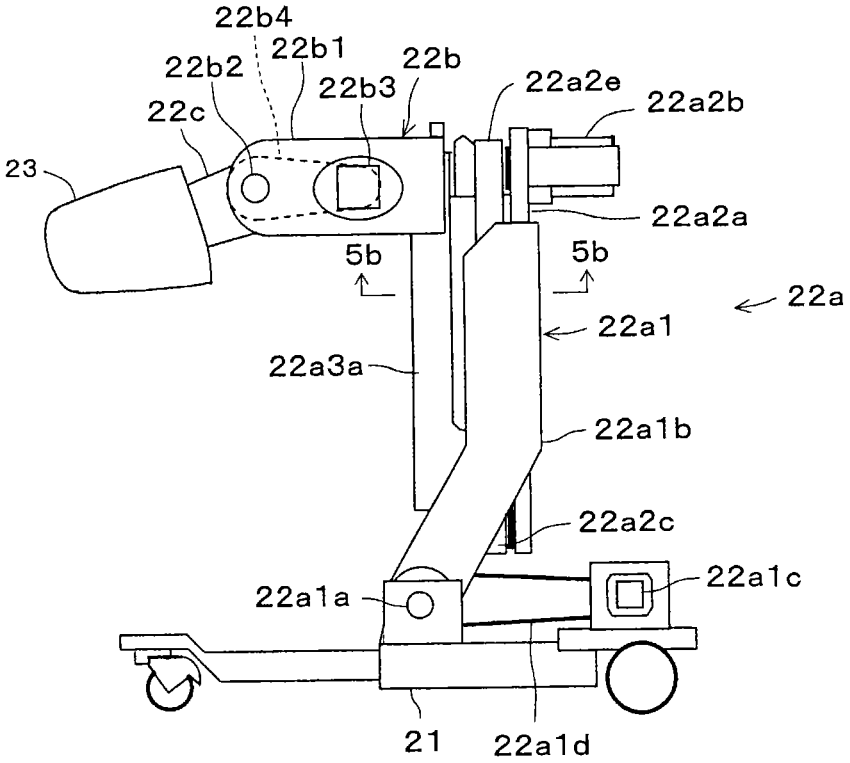
FIG. 5*a* is a right side view illustrating a scheme of the internal structure of the movement assistance robot illustrated in FIG. 1 which is in a contracted state.
Figure 5B:
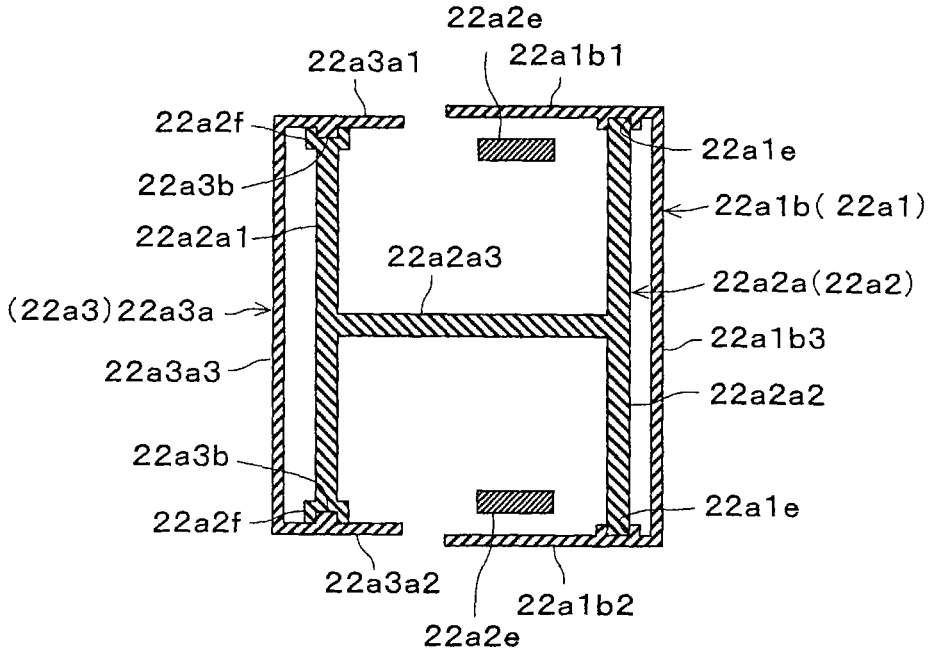
FIG. 5*b* is a cross-sectional view taken along line 5*b*-5*b* illustrated in FIG. 5*a*.

As illustrated in FIG. 5*b*, left and right guide grooves 22*a*1*e* which slidably engage with left and right ends of a rear plate-shaped member 22*a*2*a*2 of a frame 22*a*2*a* of the first slide portion 22*a*2 (to be described later) is formed inside the frame 22*a*1*b* (inside the left and right plate-shaped members 22*a*1*b*1 and 22*a*1*b*2). A stationary portion 22*a*1*f* which is attached and fixed to a sliding belt 22*a*2*e* (to be described later) is disposed in an upper portion of the left plate-shaped member 22*a*1*b*1 of the frame 22*a*1*b* (refer to FIGS. 4*b* and 5*c*).

As illustrated in FIGS. 2 and 3, the first slide portion 22*a*2 is formed in a substantially rectangular parallelepiped shape, and is configured to be smaller than the slide base portion 22*a*1. The first slide portion 22*a*2 slides on the slide base portion 22*a*1 in a longitudinal direction (shaft moving direction), and is configured to be substantially accommodated inside the slide base portion 22*a*1 when being contracted.

Specifically, the first slide portion 22*a*2 includes the frame 22*a*2*a*. As illustrated in FIG. 5*b*, the frame 22*a*2*a* is formed in an H-shape in cross section and an H-shape in a side view, and is configured to include front and rear plate-shaped members 22*a*2*a*1 and 22*a*2*a*2 and a connection plate-shaped member 22*a*2*a*3 whose front and rear ends are connected to vertically central portions of the front and rear plate-shaped members 22*a*2*a*1 and 22*a*2*a*2. Left and right ends of the rear plate-shaped member 22*a*2*a*2 slidably engage with the left and right guide grooves 22*a*1*e* of the frame 22*a*1*b*. As mainly illustrated in FIG. 4*a*, the slide-purpose motor 22*a*2*b* is disposed in an upper portion of the rear plate-shaped member 22*a*2*a*2. A pulley 22*a*2*c* is rotatably disposed in a lower portion of the rear plate-shaped member 22*a*2*a*2. The sliding belt 22a2e is disposed across a pulley 22a2d of the slide-purpose motor 22a2b and the pulley 22a2c.

Guide rails 22a2f are disposed in left and right end portions of the front plate-shaped member 22a2a1 of the frame 22a2a. The guide rails 22a2f slidably engage with left and right guide receiving portions 22a3b inside the left and right plate-shaped members of the frame 22a3a of the second slide portion 22a3 (to be described later).

As illustrated in FIGS. 2 and 3, the second slide portion 22a3 is formed in a substantially rectangular parallelepiped shape, and is configured to be smaller than the first slide portion 22a2. The second slide portion 22a3 slides on the first slide portion 22a2 in the longitudinal direction (shaft moving direction), and is configured to be substantially accommodated inside the first slide portion 22a2 when being contracted.

Specifically, the second slide portion 22a3 includes the frame 22a3a. As illustrated in FIG. 5b, the frame 22a3a is formed in a substantially U-shape in cross section, and is configured to include left and right plate-shaped members 22a3a1 and 22a3a2, and a front plate-shaped member 22a3a3 whose left and right ends are connected to front end portions of the left and right plate-shaped members 22a3a1 and 22a3a2. The left and right guide receiving portions 22a3b which slidably engage with the guide rails 22a2f of the frame 22a2a are disposed inside the frame 22a3a (inner wall surface of the left and right plate-shaped members 22a3a1 and 22a3a2). A stationary portion 22a3c which is attached and fixed to the sliding belt 22a2e is disposed in a lower portion of the right plate-shaped member 22a3a2 of the frame 22a3a (refer to FIGS. 4b and 5c).

Figure 4A:
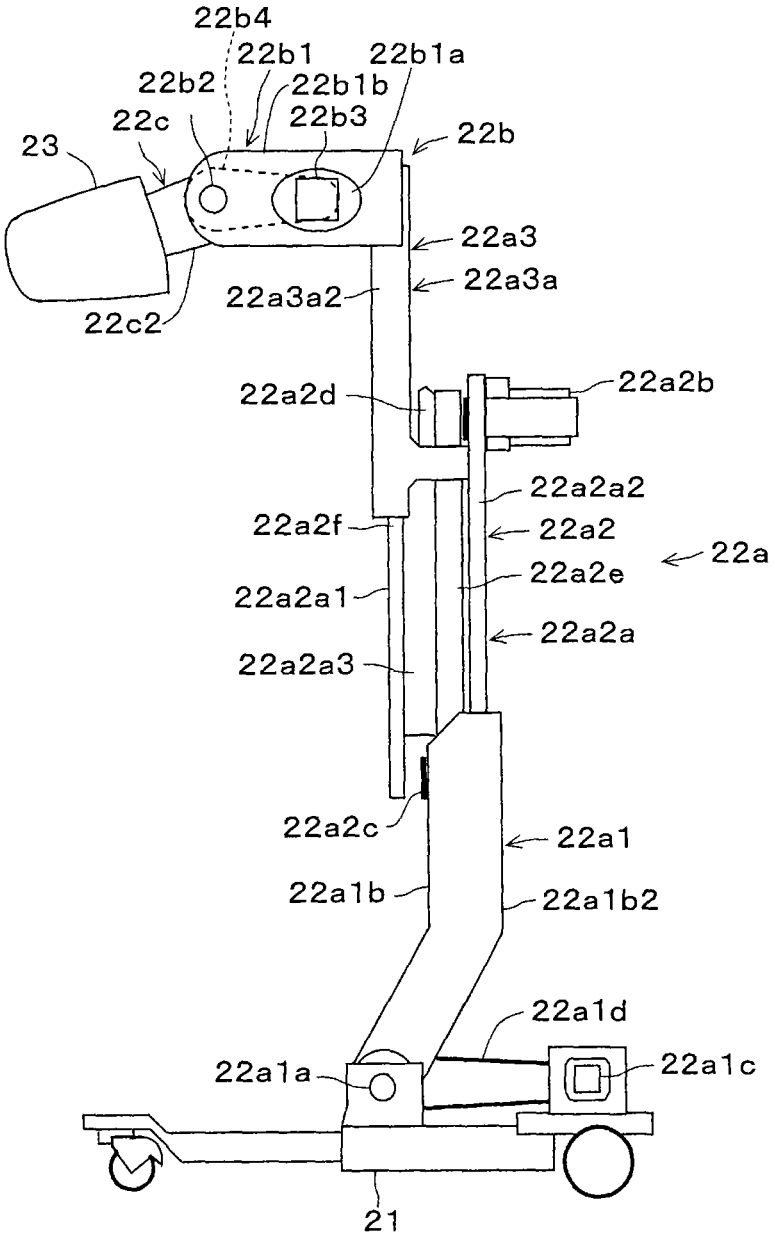
FIG. 4*a* is a right side view illustrating a scheme of an internal structure of the movement assistance robot illustrated in FIG. 1 which is in an extended state.

If the slide-purpose motor 22a2b is driven, the frame 22a2a of the first slide portion 22a2 is extended to the frame 22a1b of the slide base portion 22a1 along the shaft moving direction (extended state illustrated in FIGS. 4a and 4b). At the same time, the frame 22a3a of the second slide portion 22a3 is extended to the frame 22a2a of the first slide portion 22a2 (extended state illustrated in FIGS. 4a and 4b).

Figure 5C:
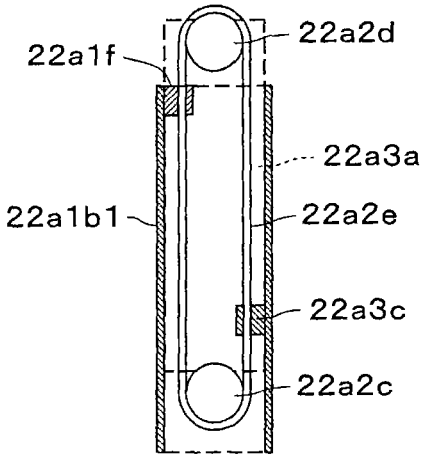
FIG. 5*c* is a front view illustrating the vicinity including the first slide portion illustrated in FIG. 5*a*.

On the other hand, if the slide-purpose motor 22a2b is driven in a reverse direction, the frame 22a2a of the first slide portion 22a2 is contracted to the frame 22a1b of the slide base portion 22a1 in the shaft moving direction (contracted state illustrated in FIGS. 5a and 5c). At the same time, the frame 22a3a of the second slide portion 22a3 is contracted to the frame 22a2a of the first slide portion 22a2 (contracted state illustrated in FIGS. 5a and 5c).

As illustrated in FIGS. 2 and 3, the second arm 22b is formed in a substantially rectangular parallelepiped shape, and is formed in a distal end portion of the second slide portion 22a3 so as to extend in a direction (forward direction) orthogonal to the longitudinal direction. Specifically, as mainly illustrated in FIG. 4a, the second arm 22b includes a frame 22b1 configured to include left and right plate-shaped members 22b1a and 22b1b. Rear end portions of the left and right plate-shaped members 22b1a and 22b1b of the frame 22b1 are respectively connected and fixed to upper end portions of the left and right plate-shaped members 22a3a1 and 22a3a2 of the frame 22a3a.

A second rotary shaft 22b2 is rotatably interposed between distal end portions of the left and right plate-shaped members 22b1a and 22b1b of the frame 22b1. A second rotation-purpose motor 22b3 is disposed in a central portion of the left and right plate-shaped members 22b1a and 22b1b. A second drive belt 22b4 is disposed across a pulley of the second rotation-purpose motor 22b3 and a pulley of the second rotary shaft 22b2.

The third arm 22c is formed in a substantially rectangular parallelepiped shape, and a base end portion thereof is attached to a distal end portion of the second arm 22b so as to be rotatable around the second rotary shaft 22b2. Specifically, the third arm 22c includes a frame 22c2. A rear end portion of the frame 22c2 is fixed so as to be rotated integrally with the second rotary shaft 22b2. A front end portion of the frame 22c2 is fixed to a rear end of the holding unit 23. If the second rotation-purpose motor 22b3 is driven, the frame 22c2, that is, the third arm 22c is rotated around the second rotary shaft 22b2 in an upward or downward direction.

The holding unit 23 is fixed to a distal end of the third arm 22c. For example, the holding unit 23 is a member which supports both arms (both armpits) of the care receiver M1 from below, when the holding unit 23 opposes the care receiver M1 in a standing-upright motion and a sitting motion of the care receiver M1. The holding unit 23 is formed in a substantially U-shape in a plan view which is open in the forward direction. For example, the holding unit 23 is formed by using a relatively soft material on the assumption that the holding unit 23 comes into contact with the care receiver M1.

The handle 24 is fixed to an upper surface of the third arm 22c. The handle 24 is configured to have a pair of left and right rod-shaped handgrips, and to be gripped by left and right hands of the care receiver M1. Contact sensors 24a and 24b for detecting the grip are disposed in the handle 24. A leftward turning switch 24c for turning the movement assistance robot 20 to the left and a rightward turning switch 24d for turning the movement assistance robot 20 to the right are disposed in the handle 24. Furthermore, a stop switch 24e for stopping the movement assistance robot 20 is disposed in the handle 24.

In addition, in a case where the care receiver M1 walks in a state of being supported by the holding unit 23, or in a case where the care receiver M1 walks in a state of gripping the handle 24, a load sensor 22c1 for detecting a force receiving from the care receiver M1 is disposed in the third arm 22c. The load sensor 22c1 may be a sensor for detecting a distortion amount of a distortion generating element which varies due to a load change, as a voltage change, or a semiconductor-type pressure sensor in which gauge resistance is changed and converted into an electrical signal in response to the distortion when a silicon chip thereof is subject to pressure.

The operation device 25 includes a display unit 25a for displaying an image and an operation section 25b for receiving an input operation from a user (caregiver M2 or care receiver M1). The operation device 25 is a selective operation unit which selects one form type (to be described later) from multiple form types in accordance with respective multiple movement postures of the care receiver M1.

The display unit 25a is configured to have a liquid crystal display, and displays a selection screen for operation modes of the movement assistance robot 20. As operation modes, a standing-upright motion assistance mode for assisting a standing-upright motion of a user, a sitting motion assistance mode for assisting a sitting motion of the user, and a movement assistance mode for assisting a movement of the user are set therein. As the movement assistance mode, a standing-upright walking assistance mode, an elbow support walking assistance mode, a hand support walking assistance mode, a standing-upright riding movement mode, and a seat riding movement mode are set therein (respectively coping with multiple movement postures of the care receiver M1).

The operation section 25*b* includes a cursor key for moving a cursor vertically and laterally, a cancellation key for canceling an input, and a determination key for determining selected content. The operation unit 25*b* is configured so that an instruction of a user can be input by using the keys. The operation device 25 may have a display function of the display unit 25*a* and an input function of the operation section 25*b*, and may be configured to have a touch panel for operating the devices by a display on a screen being pressed.

A storage device 27 stores reference coordinate data items for multiple form types which respectively cope with the multiple movement postures of the care receiver M1. The form types represent a type of a posture form (shape) of the robot arm unit 22, and respectively cope with different movement postures of the care receiver M1. For example, the standing-upright walking assistance mode, the elbow support walking assistance mode, the hand support walking assistance mode, the standing-upright riding movement mode, and the seat riding movement mode are modes respectively coping with the multiple movement postures of the care receiver M1. There are provided multiple form types respectively coping with the respective modes.

As illustrated in FIG. 8, the movement postures of the care receiver M1 include a standing-upright walking posture in the standing-upright walking assistance mode, an elbow support walking posture in the elbow support walking assistance mode, a hand support walking posture in the hand support walking assistance mode, a standing-upright riding posture in the upright riding movement mode, and a seat riding posture in the seat riding movement mode. The form types include a standing-upright walking assistance form type in the standing-upright walking assistance mode, an elbow support walking assistance form type in the elbow support walking assistance mode, a hand support walking assistance form type in the hand support walking assistance mode, a standing-upright riding movement form type in the standing-upright riding movement mode, and a seat riding movement form type in the seat riding movement mode.

The standing-upright walking assistance form type is a first form type coping with a first movement posture (standing-upright walking posture) in which the care receiver M1 walks and moves in a state of holding the holding unit 23 under his or her arms. The hand support walking assistance form type is a second form type coping with a second movement posture (hand support walking posture) in which the care receiver M1 walks and moves while gripping and pressing the handle 24 disposed in the distal end portion of the robot arm unit 22. The elbow support walking assistance form type is a third form type coping with a third movement posture (elbow support walking posture) in which the care receiver M1 walks and moves while placing his or her elbow on and pressing the upper surface of the holding unit 23. These form types are walking movement form types coping with walking movement postures in which the care receiver M1 walks and moves.

The standing-upright riding movement form type is a fourth form type coping with a fourth movement posture (standing-upright riding posture) in which the care receiver M1 moves in a riding state of standing on the footrest 32 disposed in the base 21. The seat riding movement form type is a fifth form type coping with a fifth movement posture (seat riding posture) in which the care receiver M1 moves in a state of sitting on the chair 33 disposed in the base 21. These form types are riding movement form types coping with the riding movement postures in which the care receiver M1 moves in a riding state.

The reference coordinate data is coordinate data serving as a reference formed for each of the multiple form types. For example, the coordinate data is configured to include a first angle (θa) which is the rotation angle of the first rotation-purpose motor 22*a*1*c*, an arm length (L: slide amount: rotation angle corresponding to the arm length) of the slide-purpose motor 22*a*2*b*, and a second angle (θb) which is the rotation angle of the second rotation-purpose motor 22*b*3.

As illustrated in FIG. 9, the reference coordinate data coping with the above-described respective form types is stored in the storage device 27 as a list table. Specifically, the standing-upright walking assistance form type is a posture form (shape) of the robot arm unit 22 which is formed based on standing-upright walking reference coordinate data (θa1, L1, θb1). The elbow support walking assistance form type is a posture form (shape) of the robot arm unit 22 which is formed based on elbow support walking reference coordinate data (θa2, L2, θb2). The hand support walking assistance form type is a posture form (shape) of the robot arm unit 22 which is formed based on hand support walking reference coordinate data (θa3, L3, θb3). The standing-upright riding movement form type is a posture form (shape) of the robot arm unit 22 which is formed based on standing-upright riding reference coordinate data (θa4, L4, θb4). The seat riding movement form type is a posture form (shape) of the robot arm unit 22 which is formed based on seat riding reference coordinate data (θa5, L5, θb5).

Furthermore, the storage device 27 stores a correction amount (first correction amount) according to the inclination of a floor surface. The first correction amount is a value for correcting the above-described respective reference coordinate data items. For example, when an inclination angle θ is +θ1, the first correction amount is +Δθa1 with regard to the first angle θa, and the first correction amount is −ΔLa1 with regard to the arm length L. In addition, when the inclination angle θ is −θ1, the first correction amount is −Δθa1 with regard to the first angle θa, and the first correction amount is +ΔLa1 with regard to the arm length L. The first correction amount is stored each time the inclination angle θ is changed to a predetermined angle. The correction amount may be also stored with regard to the second angle θb.

When the movement assistance robot 20 approaches an upward inclined surface from a flat floor surface, the inclination angle θ shows "+", and when the movement assistance robot 20 approaches a downward inclined surface from the flat floor surface, the inclination angle θ shows "−". In addition, in the first angle θa (or the second angle θb) in FIG. 8, "+" indicates clockwise rotation of the slide base portion 22*a*1, and "−" indicates counterclockwise rotation thereof.

The first correction amounts +θa1 and −Δθa1 with regard to the first angle θa and the first correction amounts −ΔLa1 and +ΔLa1 with regard to the arm length L are set so that the upper body of the care receiver M1 is in a vertical posture or in a forward leaning posture when the care receiver M1 moves along an upward slope, and so that the upper body of the care receiver M1 is in a vertical posture or in a rearward leaning posture when the care receiver M1 moves along a downward slope.

In addition, the storage device 27 stores a correction amount (second correction amount) according to the height of the care receiver M1. The second correction amount is a value for correcting the above-described respective reference coordinate data items. The above-described respective reference coordinate data items are data items when the height of the care receiver M1 shows a predetermined value (for example, average height; specifically, 170 cm).

For example, when the height is +ΔH1, the second correction amount is −Δφa1 with regard to the first angle θa, the second correction amount is +ΔLb1 with regard to the arm length L, and the second correction amount is +Δφb1 with regard to the second angle θb. In addition, when the height is −ΔH1, the second correction amount is +Δφa1 with regard to the first angle θa, the second correction amount is −ΔLb1 with regard to the arm length L, and the second correction amount is +Δφb1 with regard to the second angle θb. The second correction amount is stored each time a difference from the predetermined value shows a predetermined amount. These correction amounts are set in advance based on data obtained through experiments using an actual device so as to have a suitable form according to the heights in each form type. The above-described respective correction amounts are stored as a map. However, the correction amounts may be stored as calculation expressions.

Figure 6:
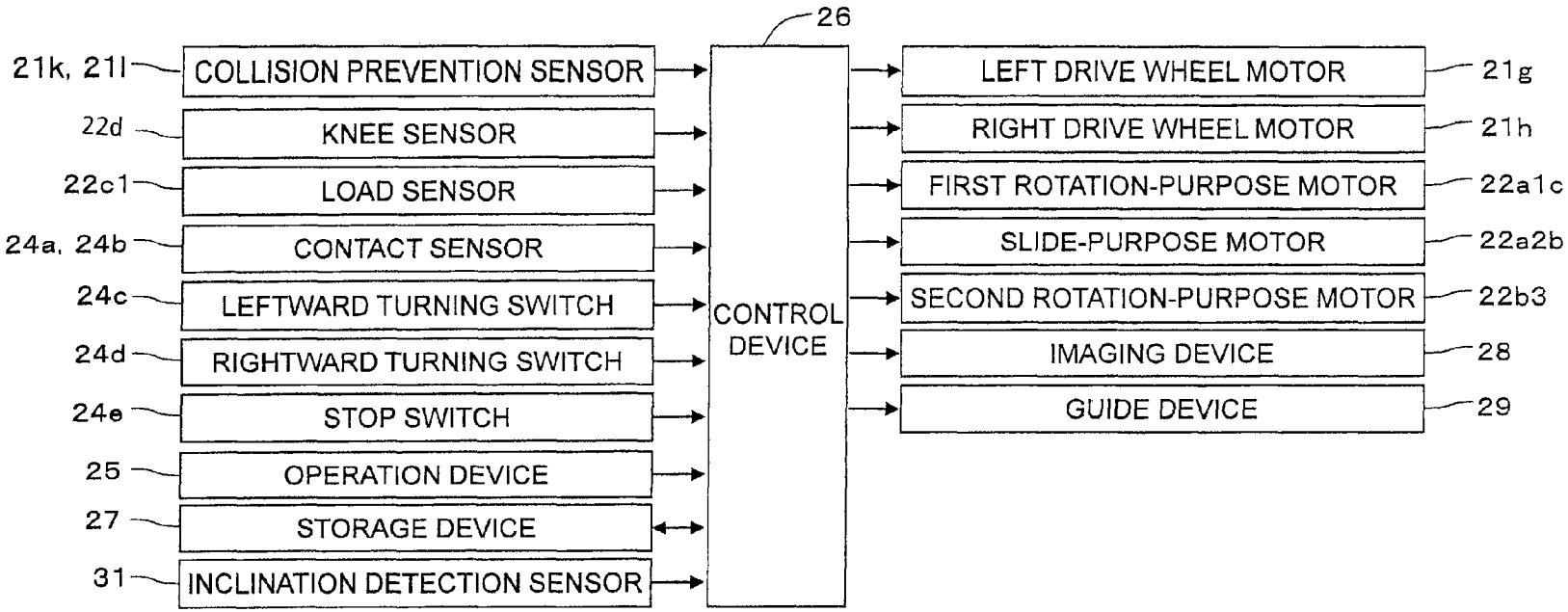
FIG. 6 is a block diagram illustrating the movement assistance robot illustrated in FIG. 1.

The control device 26 performs control related to traveling or posture transformation of the movement assistance robot 20. As illustrated in FIG. 6, the above-described collision prevention sensors 21*k* and 21*l*, a knee sensor 22*d*, the load sensor 22*c*1, the contact sensors 24*a* and 24*b*, the leftward turning switch 24*c*, the rightward turning switch 24*d*, the stop switch 24*e*, the left and right drive wheel motors 21*g* and 21*h*, the first rotation-purpose motor 22*a*1*c*, the slide-purpose motor 22*a*2*b*, the second rotation-purpose motor 22*b*3, the operation device 25, the storage device 27, the imaging device 28, the guide device 29, and the inclination detection sensor 31 are connected to the control device 26. In addition, the control device 26 has a microcomputer (not illustrated). The microcomputer includes an I/O interface, a CPU, a RAM, and a ROM (all are not illustrated) which are connected to one another via a bus.

Figure 7:
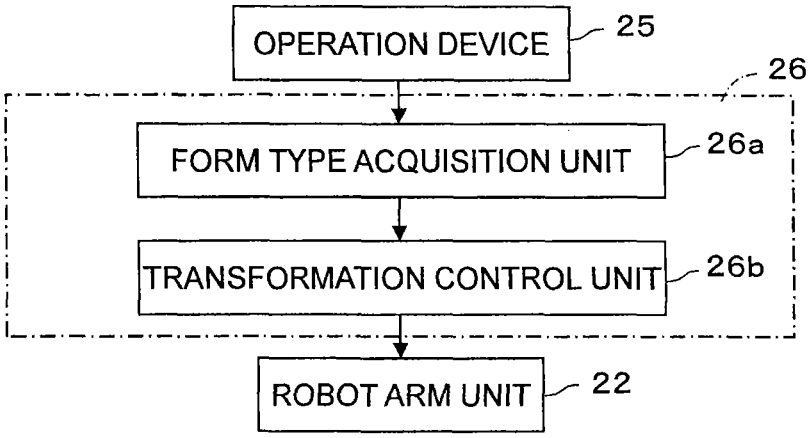
FIG. 7 is a block diagram illustrating a control device illustrated in FIG. 6.

As illustrated in FIG. 7, the control device 26 includes a form type acquisition unit 26*a* and a transformation control unit 26*b*. The form type acquisition unit 26*a* acquires a movement assistance mode of the movement assistance robot 20 which is selected by the operation device 25.

The transformation control unit 26*b* drives a drive unit configured to include the first and second rotation-purpose motors 22*a*1*c* and 22*b*3 and the slide-purpose motor 22*a*2*b*, and transforms the robot arm unit 22 into a form type which is selected by the operation device 25. Specifically, the transformation control unit 26*b* reads the reference coordinate data coping with the form type selected by the form type acquisition unit 26*a* from the storage device 27. Then, the transformation control unit 26*b* drives the drive unit so as to cope with the read reference coordinate data.

In the above-described respective form types, the control device 26 adjusts respective forms of the robot arm unit 22 according to the inclination of the floor surface on which the movement assistance robot 20 moves. Specifically, the control device 26 inputs the inclination angle θ from the inclination detection sensor 31, and reads a correction amount (first correction amount) according to the input inclination angle θ from the storage device 27. Then, the control device 26 drives the drive unit, and adjusts a form (posture) of the robot arm unit 22 which is transformed to follow the reference coordinate data so as to be adjusted by the correction amount.

In addition, in the above-described respective form types, the control device 26 adjusts respective forms of the robot arm unit 22 so as to correspond to the height of the care receiver M1. Specifically, the control device 26 inputs the height of the care receiver M1 from the operation device 25 operated by a user, and reads a correction amount (second correction amount) according to a difference ΔH from the input height from the storage device 27. Then, the control device 26 drives the drive unit, and adjusts a form (posture) of the robot arm unit 22 which is transformed to follow the reference coordinate data so as to be adjusted by the correction amount.

The imaging devices 28 are respectively disposed on a front surface of the slide base portion 22*a*1 and a rear surface of the first slide portion 22*a*2. The imaging device 28 disposed on the front surface of the slide base portion 22*a*1 images a target located forward from the movement assistance robot 20. The imaging device 28 disposed on the rear surface of the first slide portion 22*a*2 images a target located rearward or upward from the movement assistance robot 20.

The movement assistance robot 20 includes the guide device 29 which guides a state of the movement assistance robot 20 to surrounding persons including the care receiver M1 and the caregiver M2 by using a sound or a display. The guide device 29 may be a speaker for outputting sound, or a display device such as an LCD or an LED for displaying characters or graphics.

Next, an operation of the movement assistance robot 20 configured as described above will be described. First, a movement of the movement assistance robot 20 will be described. A case will be described in which the movement assistance robot 20 moves alone from the station 11 to the respective private rooms 13*a* to 13*d* (or from the respective private rooms 13*a* to 13*d* to the station 11). When moving through the corridor 14 from the station 11 to the respective private rooms 13*a* to 13*d*, the movement assistance robot 20 moves along a route stored in advance in the storage device 27, which is a route from the entrance/exit 11*a* of the station 11 to the respective entrances/exits 13*a*1 to 13*d*1 of the respective private rooms 13*a* and 13*d*.

In addition, the movement assistance robot 20 reads guiding marks 14*a* disposed in the corridor 14 via the imaging device 28, calculates the remaining traveling distance from the information, and moves based on the calculation result. For example, the guiding marks 14*a* may be two-dimensional bar codes. The two-dimensional bar codes store information items such as a current location (for example, intersection of the corridors 14), and a distance and a direction from the current location to a destination (for example, distance and direction (leftward turning) from the intersection to the first private room 13*a* when the movement assistance robot 20 approaches the intersection of the corridors 14 in a case where the movement assistance robot 20 moves from the station 11 to the first private room 13*a*). The guiding marks 14*a* are disposed at corners of the entrance/exit 11*a* of the station 11, the respective entrances/exits 13*a*1 to 13*d*1 of the respective private rooms 13*a* to 13*d*, and predetermined locations of the corridors 14 (for example, a corner at the intersection or a ceiling surface).

Next, a case will be described in which the movement assistance robot 20 comes close to the sitting care receiver M1. In this case, the movement assistance robot 20 enters the first private room 13*a* through the entrance/exit 13*a*1 of the first private room 13*a*, and then, comes close to the care receiver M1 who sits on an edge of a bed. The movement assistance robot 20 moves forward while the front surface of the movement assistance robot 20 is oriented in the traveling direction. The movement assistance robot 20 reads the guiding marks 14*b* disposed in the vicinity of the care receiver M1 via the imaging device 28 disposed on the front surface, and comes close to the care receiver M1 based on the information.

Furthermore, a standing-upright operation and a seating operation of the movement assistance robot 20 will be described with reference to FIGS. 10 and 11. The movement assistance robot 20 uses a detection result (distance between the movement assistance robot 20 and the knee of the care receiver M1) of the knee sensor 22*d*, and moves to a predetermined position where a distance from the sitting care receiver M1 becomes a predetermined distance. The predetermined position is the optimum position for allowing the care receiver M1 to stand upright (standing-upright optimum position).

Then, the movement assistance robot 20 guides the care receiver M1, "Please grip the handle". If the care receiver M1 grips the handle 24 with both hands, the contact sensors 24*a* and 24*b* detect that the handle 24 is gripped. Accordingly, the movement assistance robot 20 performs a standing-upright operation for allowing the care receiver M1 to stand upright. At this time, a standing-upright walking assistance mode is previously selected by a user or by the care receiver M1.

Figure 10:
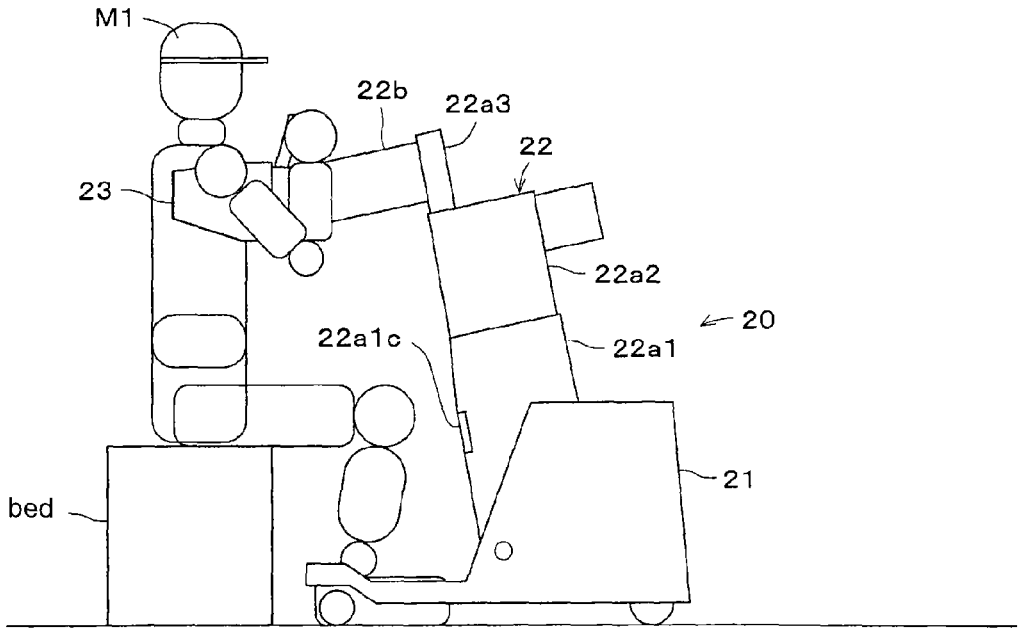
FIG. 10 is a side view illustrating a state where the movement assistance robot supports a sitting care receiver.
Figure 11:
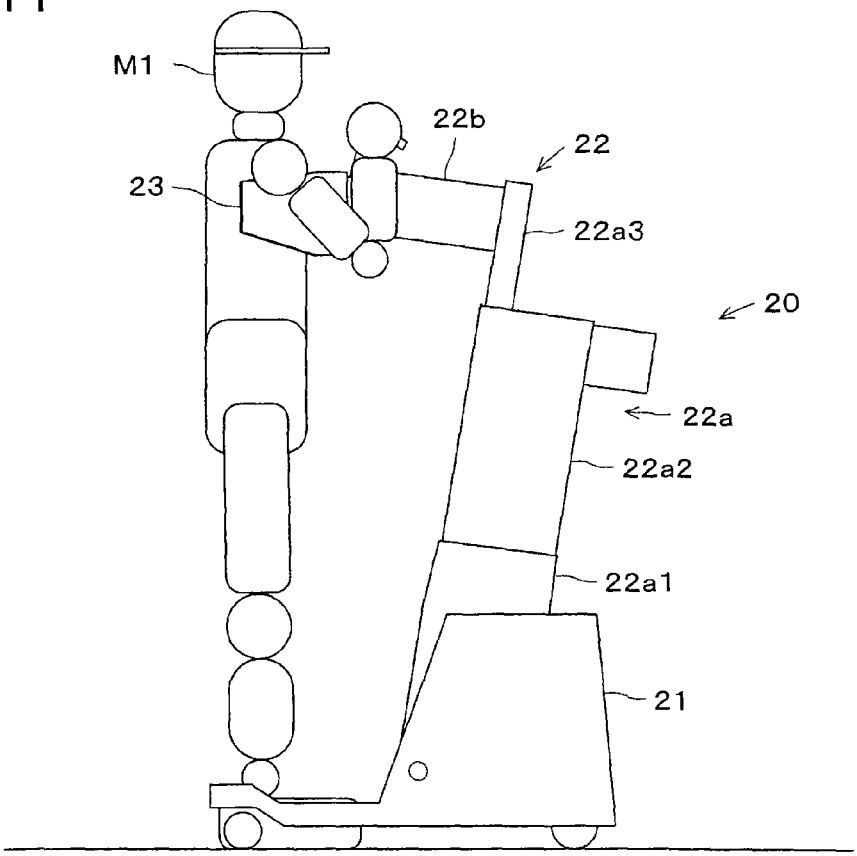
FIG. 11 is a side view illustrating a state where the movement assistance robot supports a care receiver standing upright.

If the standing-upright operation starts, the movement assistance robot 20 causes the holding unit 23 to hold the upper body of the sitting care receiver M1 (refer to FIG. 10). Then, while holding the upper body, the movement assistance robot 20 brings the care receiver M1 into a standing-upright state (refer to FIG. 11). At this time, the robot arm unit 22 is transformed into a standing-upright walking assistance form type.

The movement assistance robot 20 assists the care receiver M1 in the standing-upright state. The care receiver M1 walks and moves while holding the holding unit 23 under his or her arms (standing-upright walking assistance mode). In a case where the movement assistance robot 20 assisting the walking of the care receiver M1 in this way moves from the first private room 13*a* to the training room 12, similarly to the above-described case where the movement assistance robot 20 moves alone, the movement assistance robot 20 moves along a route stored in advance, or moves while causing the imaging device 28 to read the guiding marks 14*a*.

The movement assistance robot 20 turns to the right at the entrance/exit 13*a*1 of the first private room 13*a*, comes out to the corridor 14, turns to the right at the intersection of the corridors 14, turns to the left at the entrance/exit 12*a* of the training room 12, and enters the training room 12. The movement assistance robot 20 moves forward while the rear surface of the movement assistance robot 20 is oriented in the traveling direction.

Figure 12:
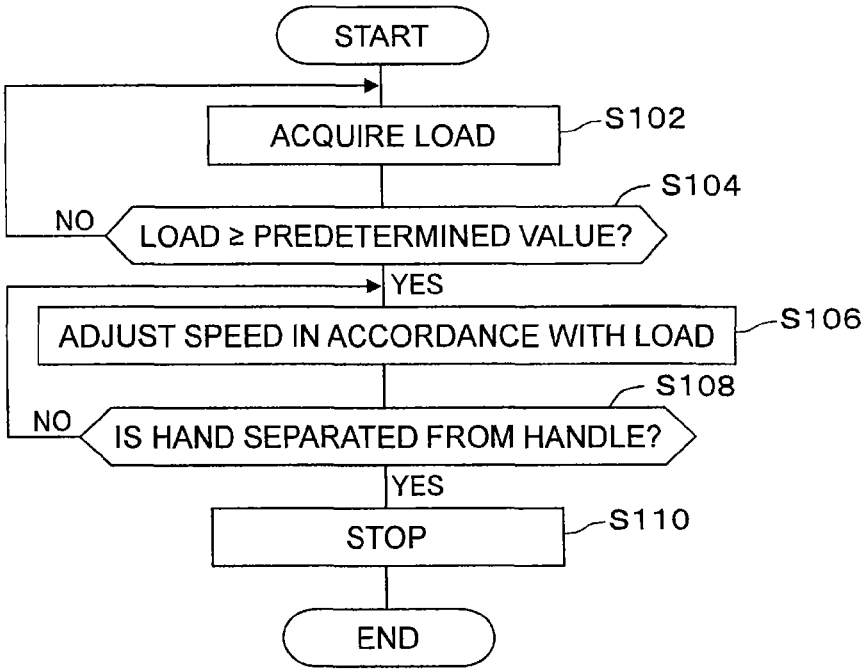
FIG. 12 is a flowchart of a program executed in the control device illustrated in FIG. 6.

At this time, the care receiver M1 walks while pushing the movement assistance robot 20. In accordance with a flowchart illustrated in FIG. 12, the control device 26 causes the load sensor 22*c*1 to detect a pressing force of the care receiver M1, and acquires a detection value thereof (Step S102). When the load detected by the load sensor 22*c*1 is equal to or greater than a predetermined value (for example, 50 N), the control device 26 starts walking by driving the left and right drive wheel motors 21*g* and 21*h* ("YES" in Step S104). The control device 26 adjusts speed by driving the left and right drive wheel motors 21*g* and 21*h* according to a magnitude of the load detected by the load sensor 22*c*1 (Step S106). When determining that the care receiver M1 releases his or her hands from the handle 24 based on the detection result of the contact sensors 24*a* and 24*b* ("YES" in Step S108), the control device 26 stops the movement of the movement assistance robot 20 (Step S110).

The above-described control is also similar in the hand support walking assistance mode. If it is assumed that the handle 24 is gripped, the elbow support walking assistance mode can also be controlled similarly to the standing-upright walking assistance mode. In addition, basically, the riding movement mode is automatically controlled similarly to independent traveling of the movement assistance robot 20.

In addition, in the standing-upright walking assistance mode, the elbow support walking assistance mode, the hand support walking assistance mode, the standing-upright riding movement mode, and the seat riding movement mode, the movement assistance robot 20 is used for one purpose of moving the care receiver M1, but is used for another purpose of the training of the care receiver M1. That is, in a mode where the care receiver M1 walks and moves with his or her own force (on foot), the body of the care receiver M1 is totally trained as compared to the riding movement mode.

In a case of the walking movement mode, a load applied to the body increases (becomes greater) in the order of the standing-upright walking assistance mode, the elbow support walking assistance mode, and the hand support walking assistance mode. In other words, the physical ability of the care receiver M1 is more highly required in the order of the standing-upright walking assistance mode, the elbow support walking assistance mode, and the hand support walking assistance mode. In the standing-upright walking assistance mode, the upper body of the care receiver M1 is supported by the holding unit 23. In contrast, in the hand support walking assistance mode, the upper body of the care receiver M1 is not supported by the holding unit 23. The care receiver M1 supports the upper body with his or her own force, and has to push the movement assistance robot 20 by using the upper body including the hands. The elbow support walking assistance mode is an intermediate mode between both of these modes.

In the riding movement mode, the riding care receiver M1 also needs to adjust the balance. Accordingly, the care receiver M1 is trained depending on the physical ability. In a case of the standing-upright riding, the lower body and the upper body are trained. Ina case of the seat riding, the upper body is trained.

If the seating operation for seating the care receiver M1 starts, the movement assistance robot 20 brings the care receiver M1 in the standing-upright state (refer to FIG. 11) into a seated state while the upper body of the care receiver M1 is held by the holding unit 23 (refer to FIG. 10).

Then, if the seating operation ends, the movement assistance robot 20 guides the care receiver M1, "please release your hands from the handle". If the care receiver M1 releases his or her hands from the handle 24, the contact sensors 24*a* and 24*b* detect that his or her hands are released from the handle 24. Accordingly, the movement assistance robot 20 moves away from the care receiver M1.

According to the present embodiment, the movement assistance robot 20 is a movement assistance robot that assists the movement of the care receiver M1, and that includes the base 21 traveling while using the left and right drive wheels 21*e* and 21*f* driven by the drive source (left and right drive wheel motors 21*g* and 21*h*), the robot arm unit 22 which includes the multiple arms 22*a*, 22*b*, and 22*c* that are mutually and relatively movable by the drive unit and that are disposed in the base 21 and which is transformable into the multiple form types respectively coping with the multiple movement postures of the care receiver M1, the holding unit 23 which is disposed in the distal end portion of the robot arm unit 22 and supports the care receiver, the operation device 25 (selective operation unit) which selects one form type from the multiple form types, and the transformation control unit 26*b* which drives the drive unit and transforms the robot arm unit 22 into a form type selected by the operation device 25.

The robot arm unit 22 includes the multiple arms 22*a*, 22*b*, and 22*c* which are disposed in the base 21 traveling while using the left and right drive wheels 21*e* and 21*f* driven by the drive source (left and right drive wheel motors 21*g* and 21*h*) and which are mutually and relatively movable by the drive unit and which is configured to include the first and second rotation-purpose motors 22*a*1*c* and 22*b*3 and the slide-purpose motor 22*a*2*b*. The robot arm unit 22 is configured to be transformable into the multiple form types respectively coping with the multiple movement postures of the care receiver M1. The holding unit 23 is disposed in the distal end portion of the robot arm unit 22 so as to support the care receiver M1. The transformation control unit 26*b* drives the drive unit, and transforms the robot arm unit 22 into the form type selected by the selective operation unit 25. In this manner, a single type of movement assistance robot 20 is transformable into multiple form types respectively coping with multiple movement postures of the care receiver M1. Accordingly, it is not necessary to prepare multiple types of movement assistance robot. Therefore, it is possible to take care of care receivers who are users having different physical abilities by providing a single type of movement assistance robot. In addition, the multiple movement postures of the care receiver M1 are set to correspond to a training level of the care receiver M1. Accordingly, the care receiver M1 can move while training his or her body in accordance with his or her wish.

In addition, the robot arm unit 20 is configured to be transformable into the first form type coping with the first movement posture (standing-upright walking assistance mode) in which the care receiver M1 walks and moves while holding the holding unit 23 under his or her arms, and the second form type coping with the second movement posture (hand support walking assistance mode) in which the care receiver M1 walks and moves while gripping and pressing the handle 24 disposed in the distal end portion of the robot arm unit 22. In this manner, a single type of movement assistance robot 20 is transformable into the first form type coping with the first movement posture in which the care receiver M1 walks and moves while holding the holding unit 23 under his or her arms, and the second form type coping with the second movement posture in which the care receiver M1 walks and moves while gripping and pressing the handle 24 disposed in the distal end portion of the robot arm unit 22. Accordingly, it is possible to take care of care receivers who have different physical abilities by providing a single type of movement assistance robot 20.

In addition, the robot arm unit 22 is configured to be transformable into the walking movement form type coping with the walking movement posture (the standing-upright walking assistance mode, the elbow support walking assistance mode, and the hand support walking assistance mode) in which the care receiver M1 walks and moves, and the riding movement form type coping with the riding movement posture (the standing-upright riding movement mode and the seating riding movement mode) in which the care receiver M1 moves in the riding state. In this manner, a single type of movement assistance robot 20 is transformable into the walking movement form type coping with the walking movement posture in which the care receiver M1 walks and moves, and the riding movement form type coping with the riding movement posture in which the care receiver M1 moves in the riding state. Accordingly, it is possible to take care of care receivers who have different physical abilities by providing a single type of movement assistance robot 20.

In addition, the robot arm unit 22 is configured to be transformable into the first form type coping with the first movement posture (standing-upright walking assistance mode) in which the care receiver M1 walks and moves while holding the holding unit 23 under his or her arms, the second form type coping with the second movement posture (hand support walking assistance mode) in which the care receiver M1 walks and moves while gripping and pressing the handle 24 disposed in the distal end portion of the robot arm unit 22, the third form type coping with the third movement posture (elbow support walking assistance mode) in which the care receiver M1 walks and moves while placing his or her elbow on and pressing the upper surface of the holding unit, the fourth form type coping with the fourth movement posture (standing-upright riding movement mode) in which the care receiver M1 moves while standing and riding on the footrest 32 disposed in the base 21, and the fifth form type coping with the fifth movement posture (seat riding movement mode) in which the care receiver M1 moves while sitting and riding on the chair 33 disposed in the base 21. In this manner, a single type of movement assistance robot 20 is transformable into the first form type coping with the first movement posture in which the care receiver M1 walks and moves while holding the holding unit 23 under his or her arms, the second form type coping with the second movement posture in which the care receiver M1 walks and moves while gripping and pressing the handle 24 disposed in the distal end portion of the robot arm unit 22, the third form type coping with the third movement posture in which the care receiver M1 walks and moves while placing his or her elbow on and pressing the upper surface of the holding unit 23, the fourth form type coping with the fourth movement posture in which the care receiver M1 moves while standing and riding on the footrest 32 disposed in the base 21, and the fifth form type coping with the fifth movement posture in which the care receiver M1 moves while sitting and riding on the chair 33 disposed in the base 21. Accordingly, it is possible to take care of care receivers who have different physical abilities by providing a single type of movement assistance robot 20.

In addition, in the above-described respective form types, forms of the robot arm unit 22 are respectively adjusted in accordance with the inclination of the floor surface on which the movement assistance robot 20 moves: In this manner, it is possible to change the posture of the care receiver M1 to a stable posture in accordance with the inclination of the floor surface. Therefore, it is possible to stably assist the movement of the care receiver M1.

In addition, in the above-described respective form types, forms of the robot arm unit 22 are respectively adjusted so as to correspond to the height of the care receiver M1. In this manner, it is possible to change the posture of the care receiver M1 to the optimum posture in accordance with the height of the care receiver M1. Therefore, it is possible to stably assist the movement of the care receiver M1.

REFERENCE SIGNS LIST

10: CARE CENTER, 11: STATION, 12: TRAINING ROOM, 13*a* to 13*d*: FIRST TO FOURTH PRIVATE ROOMS, 14: CORRIDOR, 20: MOVEMENT ASSISTANCE ROBOT, 21: BASE, 21*g*, 21*h*: LEFT AND RIGHT DRIVE WHEEL MOTORS (DRIVE SOURCE), 22: ROBOT ARM UNIT, 22*a*: FIRST ARM, 22*a*1*c*: FIRST

ROTATION-PURPOSE MOTOR (DRIVE UNIT), 22*a*2*b*: SLIDE-PURPOSE MOTOR (DRIVEUNIT), 22*b*: SECONDARM, 22*b*3: SECOND ROTATION-PURPOSE MOTOR (DRIVE UNIT), 22*c*: THIRD ARM, 23: HOLDING UNIT, 24: HANDLE, 25: OPERATION DEVICE, 26: CONTROL DEVICE, 26*a*: FORM TYPE ACQUISITION UNIT, 26*b*: TRANSFORMATION CONTROL UNIT, 27: STORAGE DEVICE, 28: IMAGING DEVICE, 29: GUIDE DEVICE, 31: INCLINATION DETECTION SENSOR, M1: CARE RECEIVER, M2: CAREGIVER

The invention claimed is:

1. A movement assistance robot which assists a movement of a care receiver comprising:

a base that travels using drive wheels driven by a drive source;

a robot arm unit that includes multiple arms which are disposed in the base and are relatively movable to and from each other by a drive unit, and that is configured to be transformable into multiple form types in accordance with respective multiple movement postures of the care receiver;

a holding unit that is disposed in a distal end portion of the robot arm unit, and that supports the care receiver;

a selective operation unit that selects a form type from the multiple form types; and a transformation control unit that drives the drive unit, and that transforms the robot arm unit into the form type which is selected by the selective operation unit, wherein the robot arm unit is configured to be transformable into:

a first form type coping with a first movement posture in which the care receiver walks and moves while holding the holding unit under his or her arms, a second form type coping with a second movement posture in which the care receiver walks and moves while gripping and pressing a handle disposed in the distal end portion of the robot an unit, a third form type coping with a third movement posture in which the care receiver walks and moves while placing his or her elbow on and pressing an upper surface of the holding unit, a fourth form type coping with a fourth movement posture in which the care receiver moves while standing and riding on a footrest disposed in the base, and a fifth form type coping with a fifth movement posture in which the care receiver moves while sitting and riding on a chair disposed in the base.

2. The movement assistance robot according to claim 1, wherein in the respective form types, forms of the robot arm unit are respectively adjusted so as to correspond to a height of the care receiver.

3. A movement assistance robot which assists a movement of a care receiver comprising:

a base that travels using drive wheels driven by a drive source;

a robot arm unit that includes multiple arms which are disposed in the base and are relatively movable to and from each other by a drive unit, and that is configured to be transformable into multiple form types in accordance with respective multiple movement postures of the care receiver;

a holding unit that is disposed in a distal end portion of the robot arm unit, and that supports the care receiver;

a selective operation unit that selects a form type from the multiple form types; and a transformation control unit that drives the drive unit, and that transforms the robot arm unit into the form type which is selected by the selective operation unit, wherein in the respective form types, forms of the robot arm unit are respectively adjusted in accordance with an inclination of a floor surface on which the movement assistance robot moves.

4. The movement assistance robot according to claim 3, wherein the robot arm unit is configured to be transformable into:

a first fort type coping with a first movement posture in which the care receiver walks and moves while holding the holding unit under his or her arms, and a second form type coping with a second movement posture in which the care receiver walks and moves while gripping and pressing a handle disposed in the distal end portion of the robot arm unit.

5. The movement assistance robot according to claim 3, wherein the robot arm unit is configured to be transformable into:

a walking movement form type coping with a walking movement posture in which the care receiver walks and moves, and a riding movement form type coping with a riding movement posture in which the care receiver moves in a riding state.

6. The movement assistance robot according to claim 3, wherein in the respective form types, forms of the robot arm unit are respectively adjusted so as to correspond to a height of the care receiver.

* * * * *